US010449788B2

(12) United States Patent
Fujiwara

(10) Patent No.: US 10,449,788 B2
(45) Date of Patent: Oct. 22, 2019

(54) CUTTING DEVICE AND PRINTER

(71) Applicant: TOSHIBA TEC KABUSHIKI KAISHA, Tokyo (JP)

(72) Inventor: Tsutomu Fujiwara, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/041,019

(22) Filed: Jul. 20, 2018

(65) Prior Publication Data

US 2019/0023033 A1 Jan. 24, 2019

(30) Foreign Application Priority Data

Jul. 21, 2017 (JP) ..... 2017-142043

(51) Int. Cl.

| | |
|---|---|
| ***B41J 11/70*** | (2006.01) |
| ***B65H 35/00*** | (2006.01) |
| ***B41J 11/48*** | (2006.01) |
| ***B65H 16/10*** | (2006.01) |
| ***B65H 35/08*** | (2006.01) |

(52) U.S. Cl.

CPC ..... *B41J 11/703* (2013.01); *B41J 11/48* (2013.01); *B65H 16/106* (2013.01); *B65H 35/0086* (2013.01); *B65H 35/08* (2013.01)

(58) Field of Classification Search

CPC ..... B41J 13/00; B41J 13/0009; B41J 15/00; B41J 15/04; B41J 15/044; B41J 15/046

See application file for complete search history.

(56) References Cited

U.S. PATENT DOCUMENTS

2003/0079585 A1* 5/2003 Carriere ..... B26D 1/085 83/13
2012/0027495 A1* 2/2012 Mochida ..... B41J 11/703 400/621
2013/0064593 A1* 3/2013 Kosuge ..... B41J 11/666 400/621

FOREIGN PATENT DOCUMENTS

JP 2004-106502 A 4/2004

* cited by examiner

*Primary Examiner* — Kristal Feggins
(74) *Attorney, Agent, or Firm* — Kim & Stewart LLP

(57) ABSTRACT

A cutting device includes a fixed blade and a movable blade that slides with respect to the fixed blade during cutting, the movable blade having a first end that engages with the fixed blade at cutting start and a second end that engages with the fixed blade at cutting end, an urging member connected to the movable blade to urge the movable blade towards the fixed blade and a rotation of the movable blade in a first rotational direction, and a support for the movable blade having a shaft that rotates as the movable blade moves, the shaft having a center portion and first and second ends rotatably connected to the movable blade, wherein points of connection of the first and second ends are at locations that urge a rotation of the movable blade in a second rotational direction opposite the first rotational direction.

16 Claims, 8 Drawing Sheets

CUTTING DEVICE AND PRINTER

CROSS-REFERENCE TO RELATED APPLICATION

This application is based upon and claims the benefit of priority from Japanese Patent Application No. 2017-142043, filed Jul. 21, 2017, the entire contents of which are incorporated herein by reference.

FIELD

Embodiments described herein relate generally to a cutting device and a printer.

BACKGROUND

In the related art, in a receipt printer, predetermined information is printed on paper supplied from a paper roll set inside the printer, and a receipt is issued by cutting with the cutting device after printing. In such a receipt printer, in order to replenish the paper roll, a split type cutting device having a movable blade and a fixed blade is used in consideration of settability.

In such a split type cutting device, there has been a problem that an angle formed by the movable blade and the fixed blade easily fluctuates, and thereby accuracy is inferior to an integrated type cutting device having an integrated structure of the movable blade and the fixed blade due to cumulative dimensions of components, deflection of components, or the like.

In a slide type cutting device, there are configurations where a supporting member that makes the movable blade to move in parallel is used in order to decrease the fluctuation of the angle formed by the movable blade and the fixed blade during a cutting process. However, in such a cutting device, the angle tends to fluctuate and become smaller during the cutting process.

DETAILED DESCRIPTION

Embodiments provide a cutting device and a printer that controls a fluctuation of an angle formed by a movable blade and a fixed blade from cutting start to cutting end, and suppresses degradation in cutting performance.

In general, according to one embodiment, there is provided a cutting device including a fixed blade and a movable blade that slides with respect to the fixed blade during cutting, the movable blade having a first end that engages with the fixed blade at a start of the cutting and a second end that engages with the fixed blade at an end of the cutting, an urging member connected to the movable blade at a location that is closer to the first end than the second end to urge the movable blade towards the fixed blade and to urge a rotation of the movable blade in a first rotational direction around a rotational axis extending in a moving direction of the movable blade, and a support for the movable blade having a shaft that extends in a direction intersecting the moving direction of the movable blade and rotates as the movable blade moves, the shaft having a center portion and first and second ends that are rotatably connected to the movable blade, wherein points of connection of the first and second ends to the movable blade are at locations that urge a rotation of the movable blade around the rotational axis in a second rotational direction that is opposite to the first rotational direction.

Hereinafter, a cutting device according to an embodiment and a receipt printer including the cutting device will be described with reference to the accompanying drawings.

Figure 1:
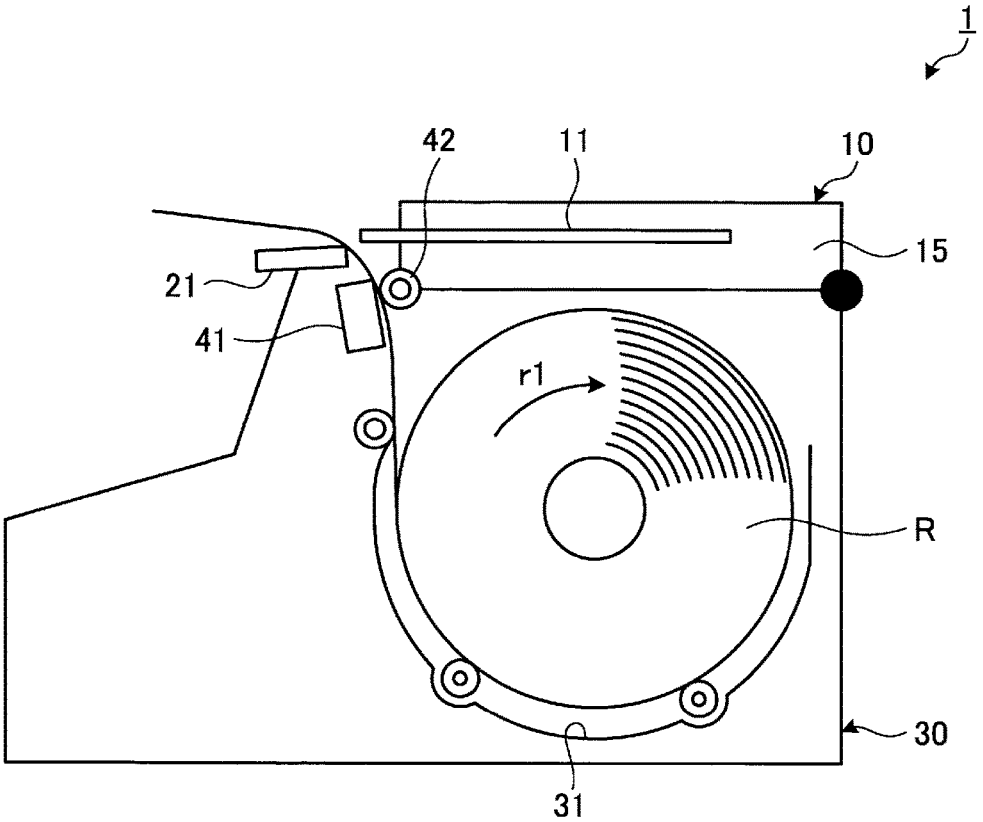
FIG. 1 is a diagram illustrating an overview of a receipt printer according to an embodiment.

FIG. 1 is a diagram illustrating an overview of a receipt printer according to an embodiment. A receipt printer 1 is provided with a receipt cover portion 10 and a main body portion 30. The receipt printer 1 is an example of a printer.

In the receipt printer 1 of the present embodiment, the receipt cover portion 10 is attached to the main body portion 30 to be openable and closable with respect to the main body portion 30. Upon receiving a command, the receipt printer 1 prints receipt information while transporting a paper from a paper roll R, cuts the printed paper, and creates a receipt.

First, the main body portion 30 will be described. The main body portion 30 is provided with a storage section 31, a thermal head 41, and a fixed blade 21 inside.

The storage section 31 accommodates the paper roll R on which paper is wound to be rotatable in the direction of arrow r1. The paper used in the present embodiment is an example of a cutting object, and, for example, can be handed to a customer as a receipt by being cut after being printing. When printing predetermined receipt information on a paper, one end of the paper is pulled by rotation of a platen roller 42, and the paper is thereby separated from the paper roll R.

In the receipt printer 1 of the present embodiment, a drop-in system in which the paper roll R is accommodated in the storage section 31 by being dropped in from above is adopted.

The thermal head 41 is brought into close contact with the platen roller 42 serving as a paper transport unit, and prints predetermined receipt information on the paper. The thermal head 41 is an example of a printing unit.

The fixed blade 21 is a blade that cuts the printed paper in a state of being fixed above the thermal head 41 at a downstream side in the transport direction of paper. In the present embodiment, the fixed blade 21 is provided so that a cutting edge 21*a* faces the movable blade 11. The fixed blade 21 is a part of a cutting mechanism of the receipt printer 1.

Figure 2:
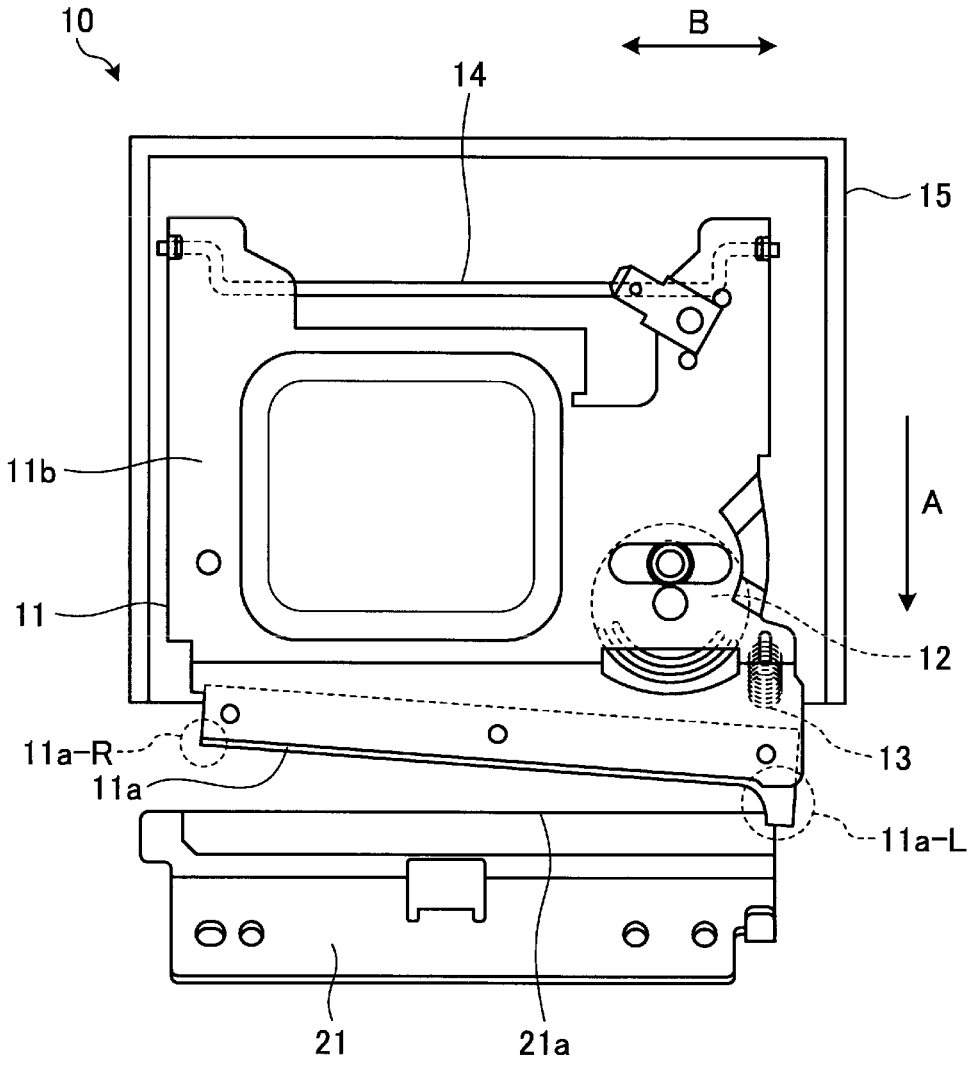
FIG. 2 is a top view of a cutting mechanism.
Figure 3:
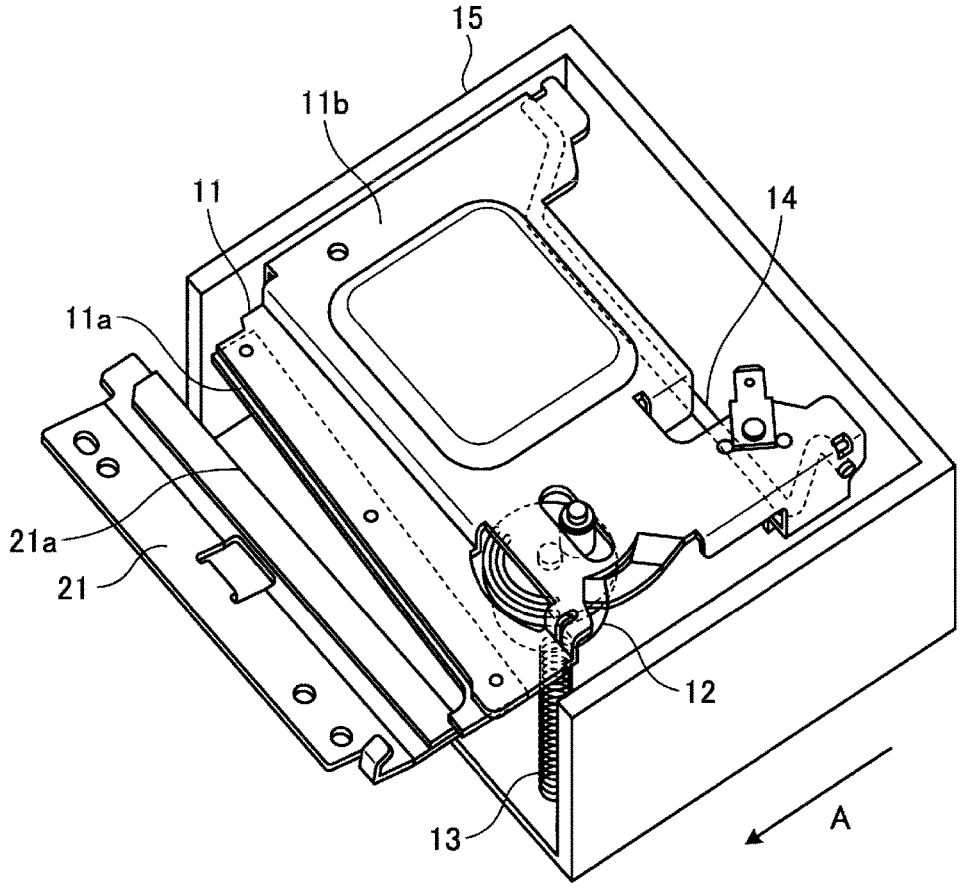
FIG. 3 is a perspective view of the cutting mechanism.

Next, the receipt cover portion 10 will be described. FIG. 2 is a top view of a cutting mechanism. FIG. 3 is a perspective view of the cutting mechanism. As shown in FIGS. 1 to 3, the receipt cover portion 10 includes the platen roller 42, a cutter frame 15, the movable blade 11, a drive cam gear 12, a cutter spring 13, and a stabilizer 14.

As shown in FIGS. 2 and 3, the cutting mechanism of the present embodiment includes the cutter frame 15, the movable blade 11, the drive cam gear 12, the cutter spring 13, the stabilizer 14, and the fixed blade 21 described above. The cutting mechanism is an example of a cutting device and may be integrated with other components such as the platen roller 42 and the thermal head 41 to form the receipt printer 1 or may be detachable from the receipt printer 1. Further, the fixed blade 21 and the movable blade 11 are examples of a cutting unit.

The platen roller 42 is rotated by a driving force transmitted from a stepping motor or the like, and transports the paper pinched between the platen roller 42 and the thermal head 41 from the storage section 31 to a paper cutting position.

The cutter frame 15 is a cover that covers the upper surface of the receipt printer 1 and is a frame body for holding various components provided in the receipt cover portion 10.

The movable blade 11 is configured such that a blade is fixed to a holding portion 11*b*, and a cutting edge 11*a* is provided so as to face the cutting edge 21*a* of the fixed blade 21.

In this embodiment, a sheet enters between the movable blade 11 and the fixed blade 21, the cutting edges of which are opposed to each other, and is conveyed from the fixed blade 21 side (below) to the movable blade 11 side (above). A gap between the cutting edge 11*a* of the movable blade 11 and the cutting edge 21*a* of the fixed blade 21 forms a part of a sheet conveying path. The cutting edge 21*a* of the fixed blade 21 is provided in parallel to the surface of the conveyed sheet. The cutting edge 11*a* of the movable blade 11 is opposed to the surface of the conveyed sheet at a predetermined angle.

Therefore, the gap between the cutting edge 11*a* of the movable blade 11 and the cutting edge 21*a* of the fixed blade 21 is smaller one end portion side in the longitudinal direction (blade base side end portion) of the movable blade 11 than the other end portion side in the longitudinal direction (blade tip side end portion).

The cutting edge 11*a* of the movable blade 11 is tilted with respect to the conveying direction of the sheet. The blade base side end portion of the movable blade 11 is located further on the sheet conveying direction downstream side than the blade tip side end portion. Further, the blade base side end portion of the movable blade 11 is located above the fixed blade 21 and overlaps a longitudinal direction one end portion of the fixed blade 21. The blade base side end portion of the movable blade 11 is urged toward the fixed blade 21 by the cutter spring 13 suspended between the cutter frame 15 and the holding portion 11*b*.

The movable blade 11 moves in the direction of arrow A in FIG. 2 to engage with the fixed blade 21 starting at one end portion and finishing at the other end portion to cut the paper. Since the cutting edge 11*a* of the movable blade 11 is provided at a position having a predetermined angle with respect to the cutting edge 21*a* of the opposing fixed blade 21, the cutting edge 11*a* of the movable blade 11 engages with the cutting edge 21*a* of the opposing fixed blade 21 over time according to the movement of the movable blade 11.

When the movable blade 11 moves toward the fixed blade 21, the cutting edge 11*a* and the cutting edge 21*a* cross at one point. The fixed blade 21 supports the movable blade 11 at this crossing point. This crossing point moves from the blade base side to the blade tip side of the movable blade 11 as the movable blade 11 moves toward the fixed blade 21.

When the crossing point moves from the blade base side to the blade tip side of the movable blade 11, the movable blade 11 moves upward. The blade base side end portion of the movable blade 11 separates from the fixed blade 21.

When the crossing point does not reach the blade tip of the movable blade 11, the blade tip side end portion of the movable blade 11 is located below the other end portion of the fixed blade 21 in the longitudinal direction. When the crossing point reaches the blade tip of the movable blade 11, the blade tip side end portion of the movable blade 11 is located on the fixed blade 21 and overlaps the other end portion of the fixed blade 21 in the longitudinal direction.

As shown in FIG. 2, the cutting edge 11*a* of the movable blade 11 of the present embodiment has a predetermined angle so that the cutting edge 11*a*-L at the left end portion is the nearest to the cutting edge 21*a* of the fixed blade 21 in the moving direction (i.e., arrow A direction) and the cutting edge 11*a*-R at the right end portion is the farthest from the cutting edge 21*a* of the fixed blade 21 in the moving direction.

The drive cam gear 12 converts the rotational motion for rotating the gear into the driving force in the arrow A direction and transmits the converted driving force to the movable blade 11 to move the movable blade 11 toward the fixed blade 21. In the present embodiment, the driving unit using a cam is provided, but as long as the movable blade 11 can be moved, a driving unit using a motor or the like may be provided.

The cutter spring 13 is connected to the cutting start side of the paper, that is, on the cutting edge 11*a*-L side of the movable blade 11 of the left end portion in the moving direction of the movable blade 11 in the present embodiment, and urges the movable blade 11. The cutter spring 13 is an example of an urging member. The cutter spring 13 of the present embodiment urges the movable blade 11 toward the fixed blade 21. When the receipt cover portion 10 is closed, the movable blade 11 is in a standby state with the movable blade 11 pressed toward the fixed blade 21 by the cutter spring 13.

When the movable blade 11 moves in the arrow A direction by the drive cam gear 12, the movable blade 11 is urged by the cutter spring 13 so that the movable blade 11 slides on the fixed blade 21. In the present embodiment, the movable blade 11 is urged by a spring, but other urging members such as a leaf spring may be used as long as the movable blade 11 can be urged.

The stabilizer 14 is rotatably connected to both end portions of the movable blade 11 in the direction of arrow B, which is orthogonal to the moving direction (i.e., arrow A direction) of the movable blade 11, and supports the movable blade 11. The stabilizer 14 of the present embodiment is rotatably connected to the movable blade 11 so that both end portions of the stabilizer 14 are inserted in a hole portion (not shown) formed at both end portions in a direction orthogonal to the moving direction of the holding portion 11*b* of the movable blade 11.

Figure 4:
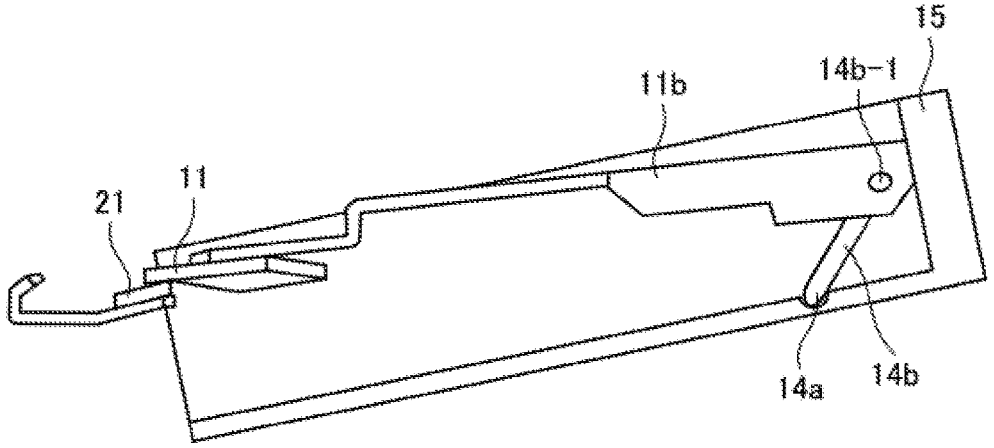
FIG. 4 is a sectional view of the cutting mechanism in a state where the holding member is attached to the cutter frame.

FIG. 4 is a sectional view of the cutting mechanism in a state that the holding member is attached to the cutter frame. As shown in FIG. 4, the rotational shaft 14*a* of the stabilizer 14 comes into contact with an inner surface of the cutter frame 15 in a turnable state. In addition, the rotational shaft 14*a* is rotatably supported, so that it does not deviate from the inner surface of the cutter frame 15.

The bending end portions 14*b*-1 and 14*c*-1 of the stabilizer 14 are rotatably supported by opposite side ends portions in the direction of arrow B of the holding portion 11*b*. Hole portions into which the bending end portions 14*b*-1 and 14*c*-1 of the stabilizer 14 are inserted, are formed at opposite side end portions of the holding portion 11*b*.

The stabilizer 14 supports the holding portion 11*b* on the inner surface of the cutter frame 15. The movable blade 11 side of the holding portion 11*b* is supported at one part by the fixed blade 21.

The holding portion 11*b* supported on the cutter frame 15 by the stabilizer 14 and the fixed blade 21 in this way reciprocates in a predetermined direction parallel to the direction of the arrow A according to driving of the drive cam gear 12. The direction in which the movable blade 11 reciprocates is a direction in which the cutting edge 11*a* of the movable blade 11 is brought close to the cutting edge 21*a* of the fixed blade 21 and brought away from the cutting edge 21*a* of the fixed blade 21.

The reciprocation of the holding portion 11*b* turns the stabilizer 14 in the cutter frame 15 with the rotational shaft 14*a* as a rotation axis. Such turning motion of the stabilizer 14 causes a reciprocating end portion of the holding portion 11*b* to move up and down.

In the present embodiment, the angle formed by the cutting edge 11*a* of the movable blade 11 and the cutting edge 21*a* of the fixed blade 21 projected onto a plane orthogonal to the moving direction (i.e., arrow A direction) of the movable blade 11 is referred to as a nip-angle. That is, the nip-angle is an angle formed by the cutting edge 11*a* of the movable blade 11 and the cutting edge 21*a* of the fixed blade 21 when the cutting mechanism is viewed from the direction opposite to the moving direction of the movable blade 11 (i.e., direction opposite to the arrow A direction). The stabilizer 14 suppresses fluctuation of the nip-angle from the start of cutting to the end of cutting the paper and is an example of a supporting member that supports the movable blade 11. The details of the stabilizer 14 will be described below.

Figure 5A:
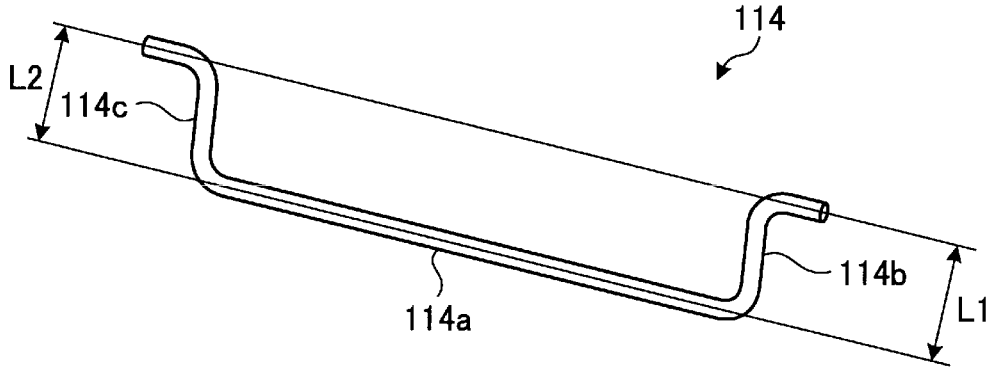
FIGS. 5A and 5B are views illustrating examples of a stabilizer.
Figure 5B:
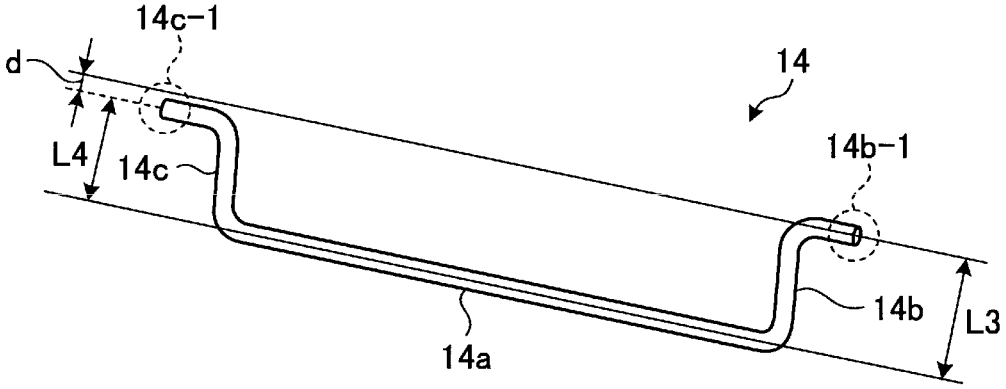

FIGS. 5A and 5B are views illustrating examples of a stabilizer. FIG. 5A shows a stabilizer 114 of the related art, and FIG. 5B shows the stabilizer 14 of the present embodiment.

As shown in FIG. 5B, in the stabilizer 14 of the present embodiment, a first portion 14*b* and a second portion 14*c* bent from both ends of the rotational shaft 14*a* are formed. The first portion 14*b* and the second portion 14*c* are formed by bending end portions 14*b*-1 and 14*c*-1 of the rotational shaft 14*a*. In other words, in the stabilizer 14, the first portion 14*b* and the second portion 14*c* are formed integrally and continuously with respect to the rotational shaft 14*a*. In the stabilizer 114 of the related art, a first portion 114*b* corresponds to the first portion 14*b*, and a second portion 114*c* corresponds to the second portion 14*c*.

As shown in FIGS. 2 and 3, the stabilizer 14 is held such that the rotational shaft 14*a* in a rotatable state on the inner bottom surface of the cutter frame 15, and the end portion 14*b*-1 is rotatably connected to the end portion on the cutting start side of the movable blade 11, and the end portion 14*c*-1 is rotatably connected to the end portion on the cutting end side of the movable blade 11.

As shown in FIG. 5A, the stabilizer 114 of the related art has a length L1 from the rotational shaft 114*a* to the connect position at the first portion 114*b*, and a length L2 from the rotational shaft 114*a* to the connect position at the second portion 114*c*, and L1 and L2 are equal to each other. On the other hand, as shown in FIG. 5B, the stabilizer 14 of the present embodiment has a length L3 from the rotational shaft 14*a* to the connect position at the first portion 14*b*, which is longer than a length L4 from the rotational shaft 14*a* to the connect position at the second portion 14*c* by a length d. In other words, L3=L4+d.

Here, the operation of the cutting mechanism will be described. FIGS. 6A to 6D are views explaining an operation of the cutting mechanism.

Figure 6A:
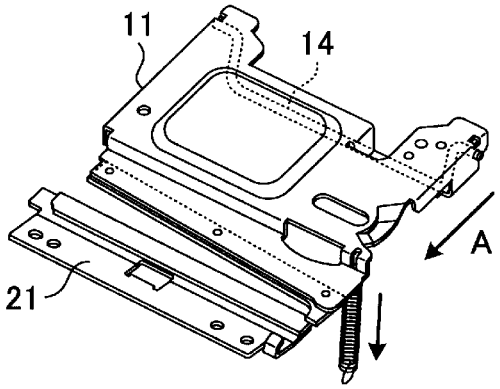
FIGS. 6A to 6D are views explaining an operation of the cutting mechanism.

First, FIG. 6A shows a standby state. In the standby state, the holding portion 11*b* is the farthest away from the fixed blade 2. At this time, the stabilizer 14 moves down to the opposite side of the fixed blade 21 (i.e., the cutting edge 11*a* of the movable blade 11) in the cutter frame 15. Therefore, a near side of the holding portion 11*b* to the fixed blade 21 (i.e., the cutting edge 11*a* side of the movable blade 11) is located above a far side from the fixed blade 21 (i.e., the opposite side of the movable blade 11). In this state, the blade base side end portion of the movable blade 11 is in contact with the fixed blade 21.

Figure 6B:
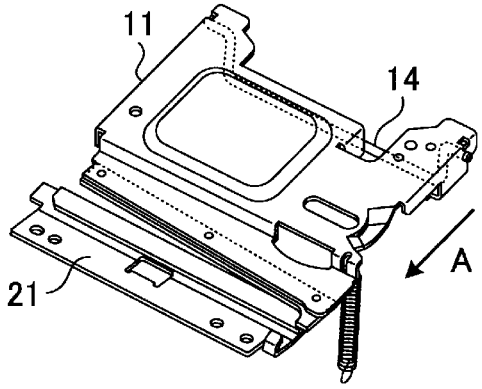

When the predetermined information is printed on the paper, the movable blade 11 starts to move in the arrow A direction by the driving force from the drive cam gear 12, and also starts to cut the paper while the stabilizer 14 rotates around the rotational shaft 14*a*, and thereby the state shown in FIG. 6B is obtained. FIG. 6B shows a state when paper cutting starts.

When the holding portion 11*b* starts to approach the cutting edge 21*a* of the fixed blade 21, the stabilizer 14 gradually rises toward the fixed blade 21 (i.e., the cutting edge 11*a* of the movable blade 11) side in the cutter frame 15. Such rising of the stabilizer 14 urges the near side of the holding portion 11*b* to the fixed blade 21 (i.e., the cutting edge 11*a* side of the movable blade 11) downward.

Therefore, an urging force toward the fixed blade 21 by the cutter spring 13 and a downward urging force by the rising of the stabilizer 14 act on the blade base side end portion of the movable blade 11 separating from the fixed blade 21 and located upward as the holding portion 11*b* approaches the cutting edge 21*a* of the fixed blade 21. These urging forces act more strongly as the crossing point moves from the blade base side to the blade tip side of the movable blade 11.

The urging forces reduce the tilt of the movable blade 11 with respect to the conveying direction of the sheet. When the tilt decreases, the sheet cannot be successfully cut and sharpness is deteriorated because, for example, the sheet slips and escapes from the crossing point.

Figure 6C:
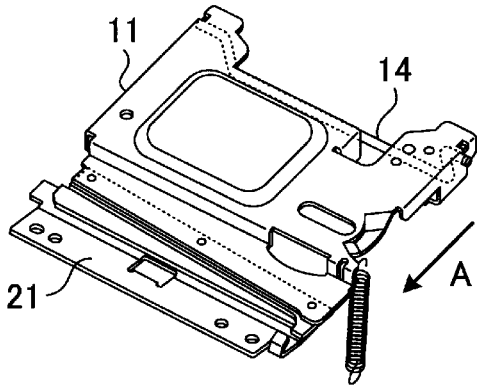
Figure 6D:
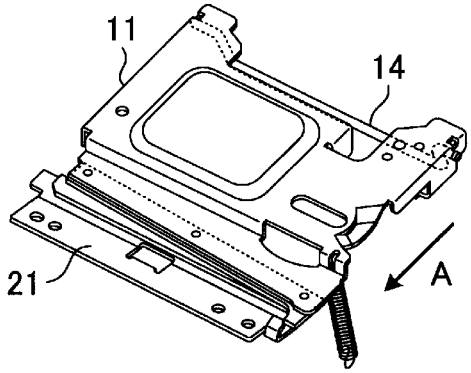

The decreasing of the tilt is affected by attachment accuracy of the movable blade 11 and the stabilizer 14 to the holding portion lib, attachment accuracy of the stabilizer 14 to the cutter frame 15, and strength of the holding portion 11*b*. Therefore, such a phenomenon more easily occurs according to continuous use of the cutter mechanism. When the movable blade 11 further moves and the stabilizer 14 also rotates, cutting of the paper is completed, and the state shown in FIG. 6C is obtained. FIG. 6C shows a paper cutting end state. Then, the movable blade 11 further moves and the stabilizer 14 also rotates and then stops, the state shown in FIG. 6D is obtained. FIG. 6D shows a completed state. As described above, when the movable blade 11 moves in the arrow A direction by the driving force from the drive cam gear 12 and cuts the paper, the stabilizer 14 rotates about the rotational shaft 14*a* and regulates movement of the movable blade 11 in the direction of the support.

Figure 7A:
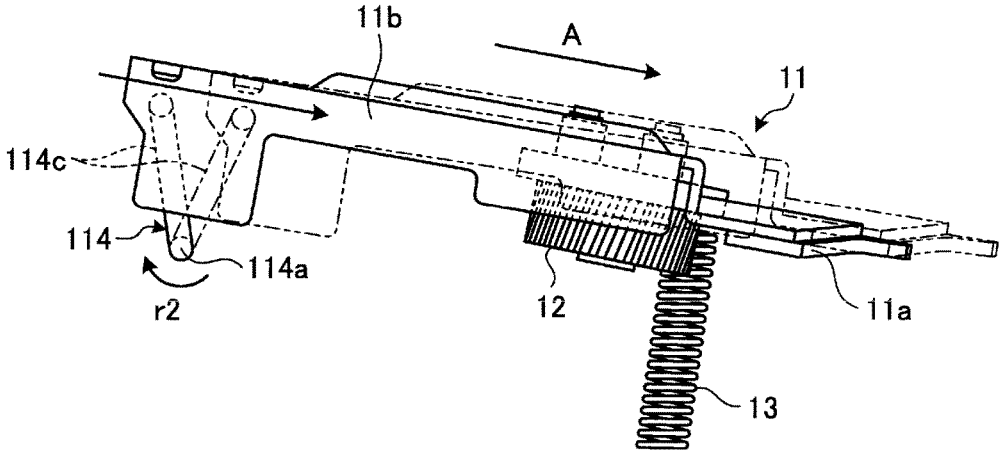
FIGS. 7A and 7B are views explaining a movement of a movable blade.
Figure 7B:
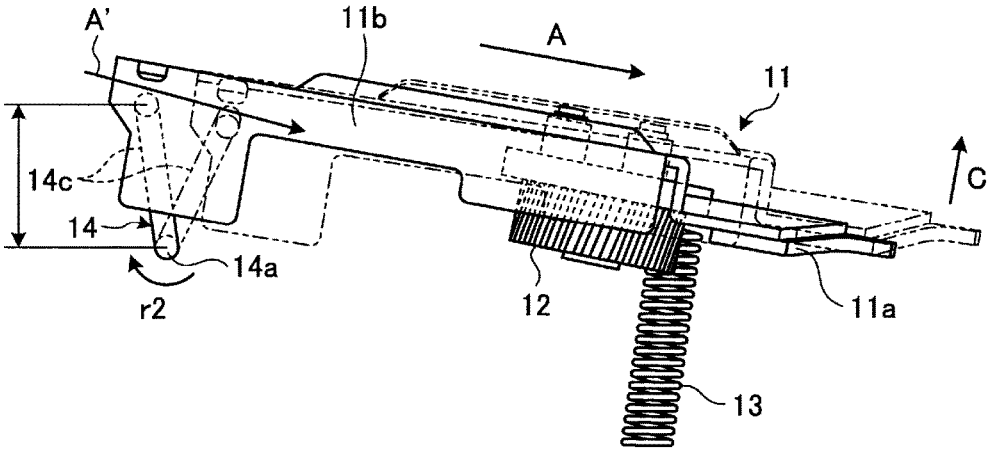

Next, with reference to FIGS. 7A to 8B, the difference in the movement of the movable blade 11 by the stabilizer 114 of the related art and the stabilizer 14 of the present embodiment will be described. FIGS. 7A and 7B are views explaining a movement of the movable blade 11. FIG. 7A shows the case of using the stabilizer 114 of the related art and FIG. 7B shows the case of using the stabilizer 14 of this embodiment. With the movement of the movable blade 11, the stabilizer 114 of the related art and the stabilizer 14 of the present embodiment rotate in the direction r2 about the rotational shafts 114*a* and 14*a*, respectively.

Figure 8A:
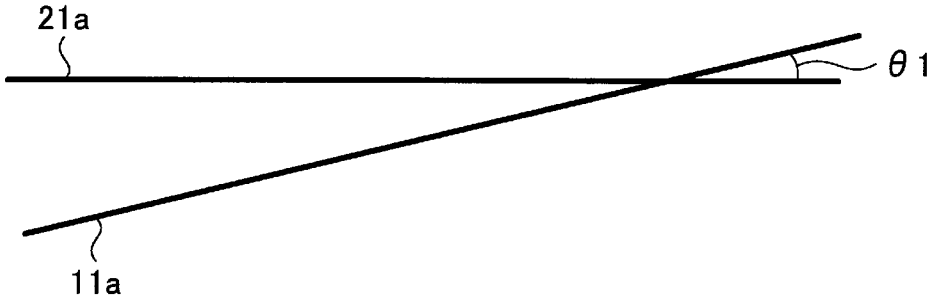
FIGS. 8A and 8B are schematic diagrams of a nip-angle.
Figure 8B:
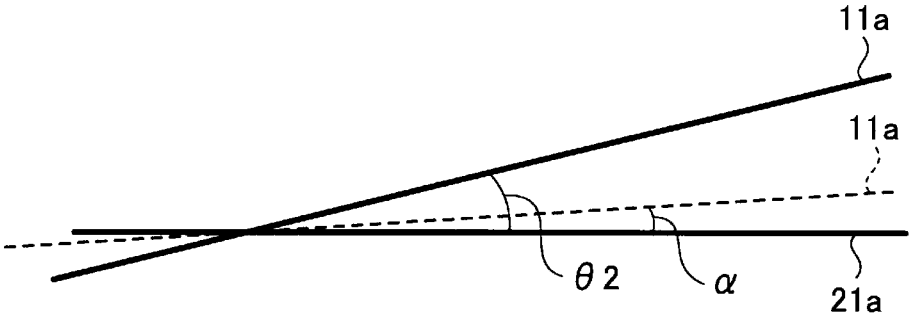

FIGS. 8A and 8B are schematic diagrams of a nip-angle. FIG. 8A shows the nip-angle at the start of cutting of paper, and FIG. 8B shows the nip-angle at the end of cutting the paper.

First, the movement of the movable blade 11 when the stabilizer 114 of the related art is used will be described with reference to FIG. 7A. In the stabilizer 114 of the related art, the length L1 from the rotational shaft 114*a* to the connect position at the first portion 114*b* and the length L2 from the rotational shaft 114*a* to the connect position at the second portion 114*c* are equal as shown in FIG. 5A.

As described above, the movable blade 11 is urged by the cutter spring 13 so as to press against the fixed blade 21 at the cutting start side. Therefore, when the movable blade 11 moves in the arrow A direction, the movable blade 11 moves in the direction of arrow A while sliding on the fixed blade 21. Therefore, as shown in FIG. 8A, the cutting edge 11*a*-R (see FIG. 2) of the movable blade 11 is inclined downward with respect to the fixed blade 21 before start of cutting of the paper. That is, at the start of cutting, the movable blade 11 and the fixed blade 21 form a nip-angle θ1.

Then, in the related art, as the movable blade 11 moves from the start of cutting of the paper to slide on the fixed blade 21, the nip-angle formed by the movable blade 11 and the fixed blade 21 decreases to angle α shown in FIG. 8B. This is because, as the movable blade 11 moves, the cutting point of the cutting mechanism shifts from the right side (i.e., cutting start side) to the left side (i.e., cutting end side).

Referring now to FIG. 7B, the movement of the movable blade 11 when the stabilizer 14 of the present embodiment is used will be described. In the stabilizer 14 of the present embodiment, the length L3 from the rotational shaft 14*a* to the first connect position at the first portion 14*b* is longer than the length L4 from the rotational shaft 14*a* to the second connect position at the second portion 14*c* by the length d as shown in FIG. 5B.

As shown in FIG. 8A, at the start of cutting the paper, the cutting edge 11*a*-R on the cutting end side of the movable blade 11 is inclined downward with respect to the fixed blade 21. In the related art, the nip-angle decreases with the sliding movement of the movable blade 11. By contrast, in the embodiment, by making the length L3 longer than the length L4, the stabilizer 14 of the present embodiment can cause an adjustment of the nip-angle with respect to the fixed blade 21. More specifically, the stabilizer 14 reduces the fluctuation of the angle from the nip-angle θ1 shown in FIG. 8A formed by the cutting edge 11*a* of the movable blade 11 at the cutting start to the nip-angle θ2 shown in FIG. 8B at the cutting end, to be within a predetermined range.

In other words, the stabilizer 14 of the present embodiment sets the height on the cutting start side (i.e., the length L3 from the rotational shaft 14*a* to the first connect position in FIGS. 5A and 5B) to be higher than the height on the cutting end side (i.e., the length L4 from the rotational shaft 14*a* to the second connect position in FIGS. 5A and 5B) by the length d. As a result, the rotational shaft 14*a* of the stabilizer 14 rotates in the r2 direction with the sliding movement of the movable blade 11 and increases the height of the movable blade 11 on the cutting start side with respect to the height on the cutting end side in the direction of the arrow C as shown in FIG. 7B.

As a result, as shown in FIG. 7B, when the driving force in the arrow A direction is given by the drive cam gear 12, the cutting end side of the movable blade 11 moves in the arrow A' direction inclined from the direction of the arrow A, and the cutting edge 11*a* on the cutting start side of the movable blade 11 is raised in the direction of the arrow C. Thereby, correction can be made so as to suppress the decrease in the nip-angle formed by the movable blade 11 and the fixed blade 21, which is generated when the cutting point between the movable blade 11 and the fixed blade 21 shifts. That is, the fluctuation of the angle from the nip-angle θ1 (FIG. 8A) at the start of cutting to the nip-angle θ2 at the end of cutting (FIG. 8B) is suppressed.

As described above, in the receipt printer 1 of the present embodiment, the length L3 of the stabilizer 14 that supports the movement of the movable blade 11 on the cutting start side is made longer than the length L4 of the cutting end side by the length d, it is possible to suppress the fluctuation of the nip-angle formed by the movable blade 11 and the fixed blade 21 from the start to the end of cutting, and suppress a reduction in cutting performance.

In addition, the receipt printer 1 of the present embodiment can maintain a sufficient nip-angle during its lifetime when taking into consideration the stability of the cutting mechanism at the beginning of use being degraded as a result of the slackness of the movable blade 11 caused by continuous use. Thus, it is possible to provide a cutting device with longer lifetimes and improved reliability without using a special mechanism such as an additional component.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cutting device comprising:

a fixed blade and a movable blade that slides with respect to the fixed blade during cutting, wherein the movable blade has a first end that engages with the fixed blade at a start of the cutting and a second end that engages with the fixed blade at an end of the cutting;

an urging member connected to the movable blade at a location that is closer to the first end than the second end to urge the movable blade towards the fixed blade and to urge a rotation of the movable blade in a first rotational direction around a rotational axis extending in a moving direction of the movable blade; and a support for the movable blade having a shaft that extends in a direction intersecting the moving direction of the movable blade and rotates as the movable blade moves, the shaft having a center portion and first and second ends that are rotatably connected to the movable blade, wherein points of connection of the first and second ends to the movable blade are at locations that urge a rotation of the movable blade around the rotational axis in a second rotational direction that is opposite to the first rotational direction.

2. The cutting device according to claim 1, wherein a distance between the point of connection of the first end to the movable blade and the center portion and a distance between the point of connection of the second end to the movable blade and the center portion are different.

3. The cutting device according to claim 1, wherein a distance between the point of connection of the first end to the movable blade and the center portion is greater than a distance between the point of connection of the second end to the movable blade and the center portion.

4. The cutting device according to claim 1, wherein the urging member is a coil spring.

5. The cutting device according to claim 1, wherein cutting edges of the movable blade and the fixed blade form a nip angle that is greater than zero when viewed in a direction opposite the moving direction.

6. The cutting device according to claim 5, wherein the nip angle at the start of the cutting and the nip angle at the end of the cutting are different.

7. The cutting device according to claim 1, wherein cutting edges of the movable blade and the fixed blade form an angle that is greater than zero when viewed in a direction that is orthogonal to a rotational axis of the shaft and the moving direction.

8. A printer comprising:

a paper roll;

a printing device configured to form an image on paper supplied from the paper roll; and a cutting device configured to cut the paper supplied from the paper roll, wherein the cutting device includes a fixed blade and a movable blade that slides with respect to the fixed blade during cutting, the movable blade having a first end that engages with the fixed blade at a start of the cutting and a second end that engages with the fixed blade at an end of the cutting, an urging member connected to the movable blade at a location that is closer to the first end than the second end to urge the movable blade towards the fixed blade and to urge a rotation of the movable blade in a first rotational direction around a rotational axis extending in a moving direction of the movable blade, and a support for the movable blade having a shaft that extends in a direction intersecting the moving direction of the movable blade and rotates as the movable blade moves, the shaft having a center portion and first and second ends that are rotatably connected to the movable blade, wherein points of connection of the first and second ends to the movable blade are at locations that urge a rotation of the movable blade around the rotational axis in a second rotational direction that is opposite to the first rotational direction.

9. The printer according to claim 8, wherein a distance between the point of connection of the first end to the movable blade and the center portion and a distance between the point of connection of the second end to the movable blade and the center portion are different.

10. The printer according to claim 8, wherein a distance between the point of connection of the first end to the movable blade and the center portion is greater than a distance between the point of connection of the second end to the movable blade and the center portion.

11. The printer according to claim 8 wherein the urging member is a coil spring.

12. The printer according to claim 8, wherein cutting edges of the movable blade and the fixed blade form a nip angle that is greater than zero when viewed in a direction opposite the moving direction.

13. The printer according to claim 12, wherein the nip angle at the start of the cutting and the nip angle at the end of the cutting are different.

14. The printer according to claim 8, wherein cutting edges of the movable blade and the fixed blade form an angle that is greater than zero when viewed in a direction that is orthogonal to a rotational axis of the shaft and the moving direction.

15. The printer according to claim 8, wherein the printing device includes a thermal head and a platen roller that is rotated to supply the paper from the paper roll.

16. The printer according to claim 8, wherein the paper roll is a receipt paper roll.

* * * * *